US009433873B2

(12) United States Patent
Howard

(10) Patent No.: US 9,433,873 B2
(45) Date of Patent: Sep. 6, 2016

(54) ROTATING DUAL EQUESTRIAN JUMP CUP

(71) Applicant: Lawrence Lee Howard, Mocksville, NC (US)

(72) Inventor: Lawrence Lee Howard, Mocksville, NC (US)

( * ) Notice: Subject to any disclaimer, the term of this patent is extended or adjusted under 35 U.S.C. 154(b) by 171 days.

(21) Appl. No.: 13/957,649

(22) Filed: Oct. 22, 2013

(65) Prior Publication Data

US 2015/0107529 A1 Apr. 23, 2015

(51) Int. Cl.
*A63K 3/04* (2006.01)

(52) U.S. Cl.
CPC ..... *A63K 3/046* (2013.01)

(58) Field of Classification Search
CPC ..... A63K 3/04; A63K 3/043; A63K 3/046; A01K 15/027; A01K 15/04
USPC ..... 119/705
See application file for complete search history.

(56) References Cited

U.S. PATENT DOCUMENTS

| | | | | | |
|---|---|---|---|---|---|
| 3,105,682 | A | * | 10/1963 | Ahrens | 482/17 |
| 3,850,401 | A | * | 11/1974 | Snediker | 248/292.13 |
| 5,334,119 | A | * | 8/1994 | Eloranta | 482/16 |
| 5,967,093 | A | * | 10/1999 | Vitt et al. | 119/705 |
| 2003/0084857 | A1 | * | 5/2003 | Gavet | 119/705 |
| 2009/0275008 | A1 | * | 11/2009 | Caruso | 434/258 |

FOREIGN PATENT DOCUMENTS

| | | | | | |
|---|---|---|---|---|---|
| DE | 10225050 | A1 | * | 12/2003 | A63K 3/04 |
| FR | 2822718 | A1 | * | 10/2002 | A63K 3/00 |
| WO | WO 2007/080192 | | * | 1/2007 | A63K 3/04 |

* cited by examiner

*Primary Examiner* — Monica Williams
*Assistant Examiner* — Christopher Hutchens

(57) ABSTRACT

A jump cup for equestrian activities which includes two curved plates for supporting the ends of two jump poles and two hinges that allows the two curved plates to rotate independently from each other and to a single pinned attachment point to a conventional jump standard.

14 Claims, 11 Drawing Sheets

JUMP CHUTE WALL
PLAN VIEW

90 DEGREE ANGLE JUMP POSTION
PLAN VIEW

SMALL ANGLE JUMP POSITION
PLAN VIEW

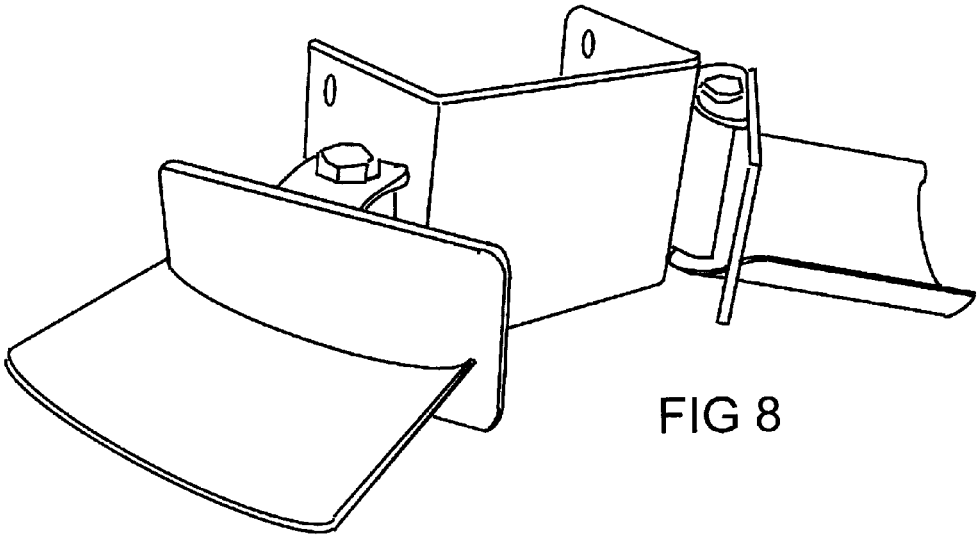
FIG 8
FIG 9A
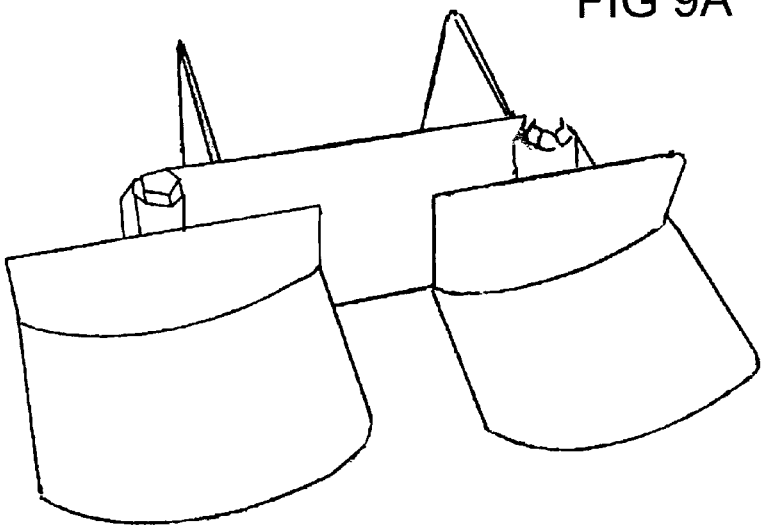

ISOMETRIC VIEW

180 DEGREE ANGLE POSITION

ANGLED JUMP FENCE

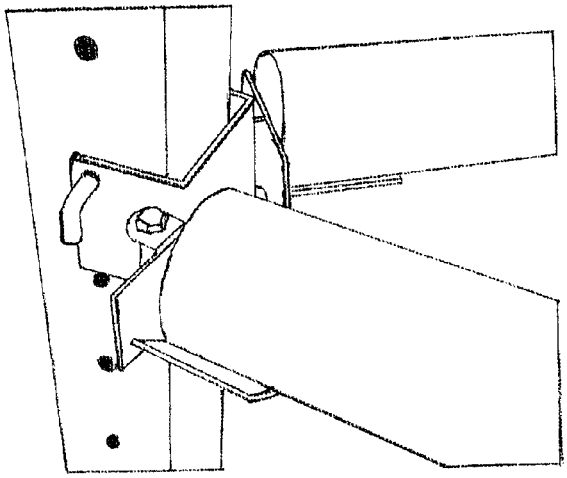
FIG 12
ANGLED JUMP FENCE CUP POSITION
FIG 13
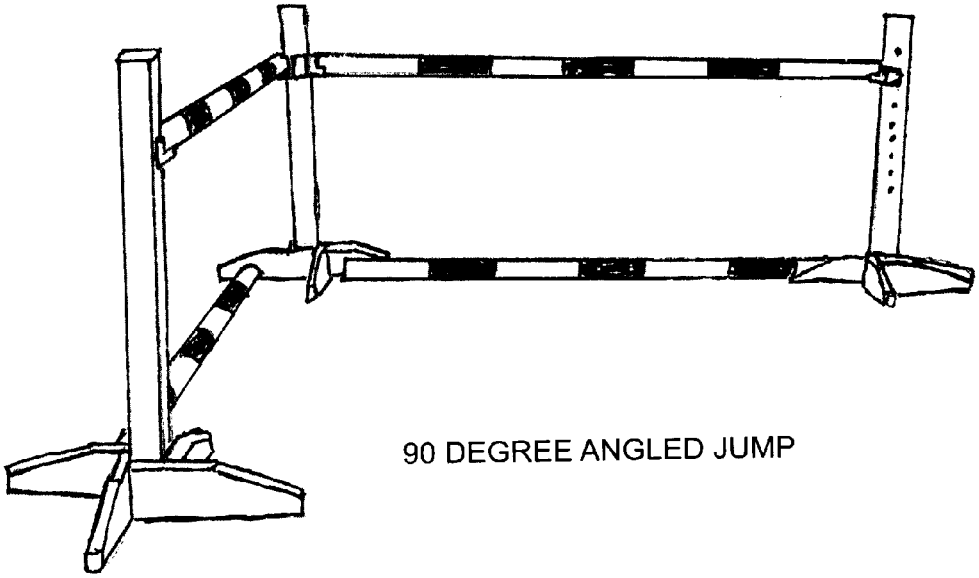
90 DEGREE ANGLED JUMP

180 DEGREE ANGLED POSITION

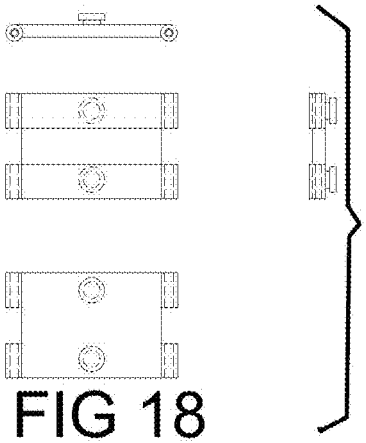
FIG 18
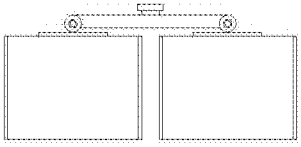
FIG 20
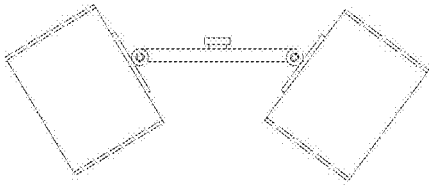
FIG 21
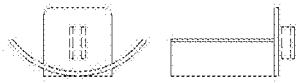
FIG 19A
FIG 19B

ROTATING DUAL EQUESTRIAN JUMP CUP

CROSS REFERENCE TO PRIOR CO-PENDING APPLICATION

This application claims the benefit of prior Provisional Patent Application 61/818,941 filed on May 3, 2013.

BACKGROUND OF THE INVENTION

The present invention relates to jump cups used in equestrian activities. A conventional jump cup supports a single jump pole in a fixed vertical and horizontal position. (See FIG. 1) In training for Corner Obstacles, horse jumps must be placed so a horse and rider can practice jumping to a narrow spread of the jump poles without causing a run out. Typically to build a corner jump the elements required consist of four jump standards, four jump cups and two jump poles. The claim of the invention is that elements required to build a Corner Obstacle will only be two conventional jump cups, three standards, two jump poles and one dual rotating jump cup, thus requiring one less jump standard and more closely simulating a competition Corner Obstacle.

A conventional jump cup 10 for equestrian activities is depicted in FIG. 2. The jump cup 10 supports a jump pole with a concave plate 18 of the jump cup 20 and a U shaped rear facing flange 22 that straddle the jump standard. The flanges include a pair of aligned holes 24 that can be matched to one of multiple vertically spaced holes formed through the side surfaces of a jump standard. A separate L shaped fastening pin or rod is inserted through the aligned jump cup flange holes 24 and the jump standard hole to secure the jump cup at designated elevation.

The conventional jump cup 10 design affixes the jump pole at 90 degrees horizontally to the jump standard face. There is no current jump cup that allows for a jump pole to be positioned at any other angle other than 90 degrees or allow for two jump poles to be independently angles from one jump stand. To accomplish an angled jump pole arrangement, two jump standards and two jump cups must be used.

SUMMARY OF THE INVENTION

The present invention allows two jump poles to be independently angled from each other while affixed to a single jump standard.

BRIEF DESCRIPTION OF THE DRAWINGS

FIG. 8 shows the dual jump cup in an acute angled position, and

FIGS. 9A and 9B are two three dimensional views of the dual jump cups in a zero angle position, while

FIG. 12 shows two jump poles held in two angled jump cups in the position shown in FIG. 11.

FIG. 13 shows a fence in a 90 degree angled jump configuration.

FIG. 18 is an exploded view of an alternate jump cup mounting member subassembly.

FIG. 19A is a top view of a jump cup used with the subassembly of FIG. 21.

FIG. 19B is a side view of the jump cup shown in FIG. 19A.

FIG. 20 is a top view of the dual jump cup assembly in a zero angle position.

FIG. 21 is a view of the dual jump cup assembly of FIG. 20 in an acute angled position.

DETAILED DESCRIPTION OF A PREFERRED EMBODIMENT OF THE INVENTION

Figure 1:
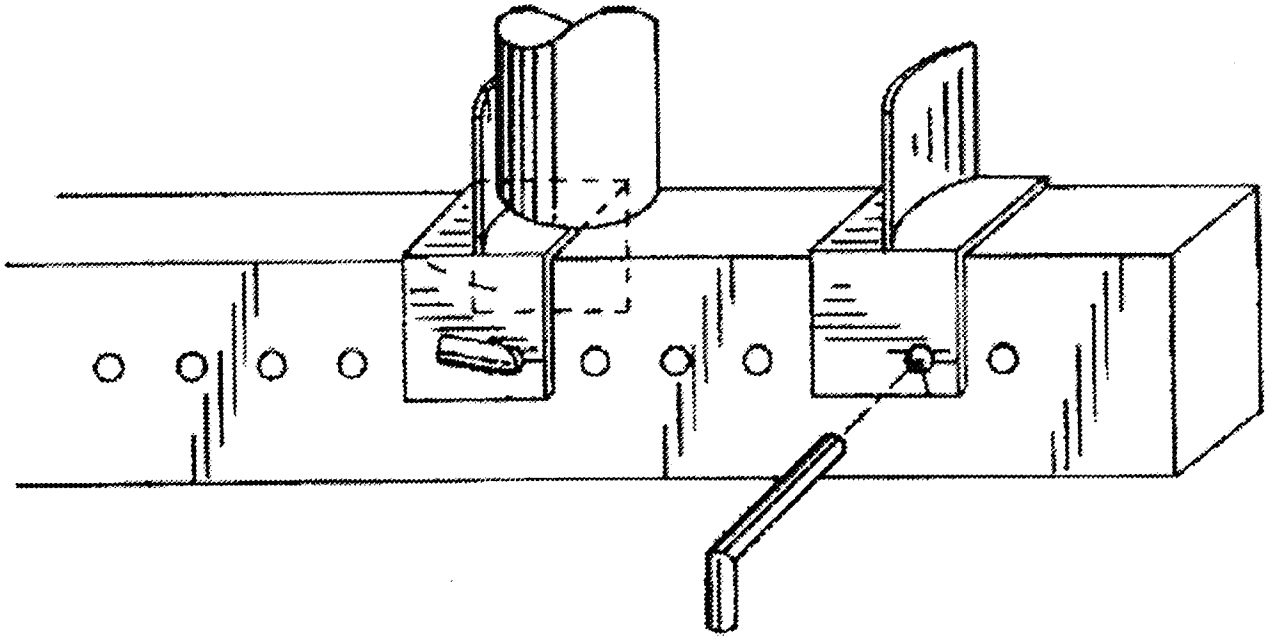
FIG 1 (PRIOR ART)
FIG. 1 is a perspective view of a conventional wooden jump standard showing the placement of a conventional jump cup and jump pole.
Figure 2:
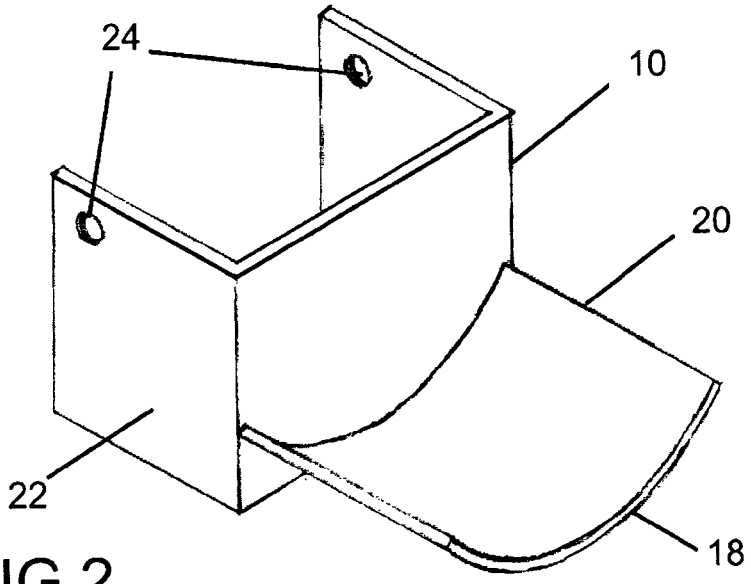
FIG 2 PRIOR ART
FIG. 2 is a perspective view of a conventional jump cup with a single concave plate affixed to the U shaped flange that is used to affix the jump cup assembly to a jump standard and supporting a single jump pole.
Figure 3:
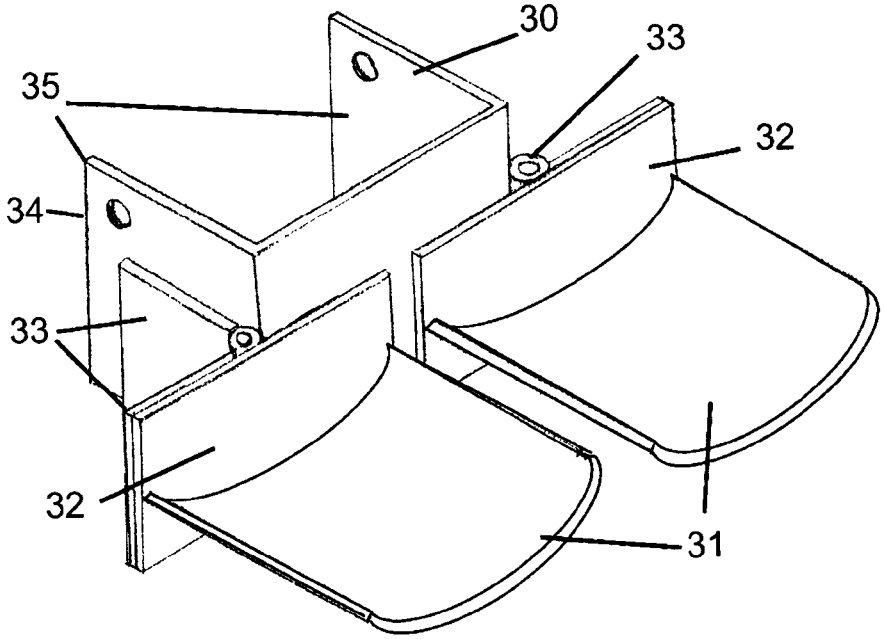
FIG. 3 is a perspective view of the dual rotating jump cup invention.
Figure 4:
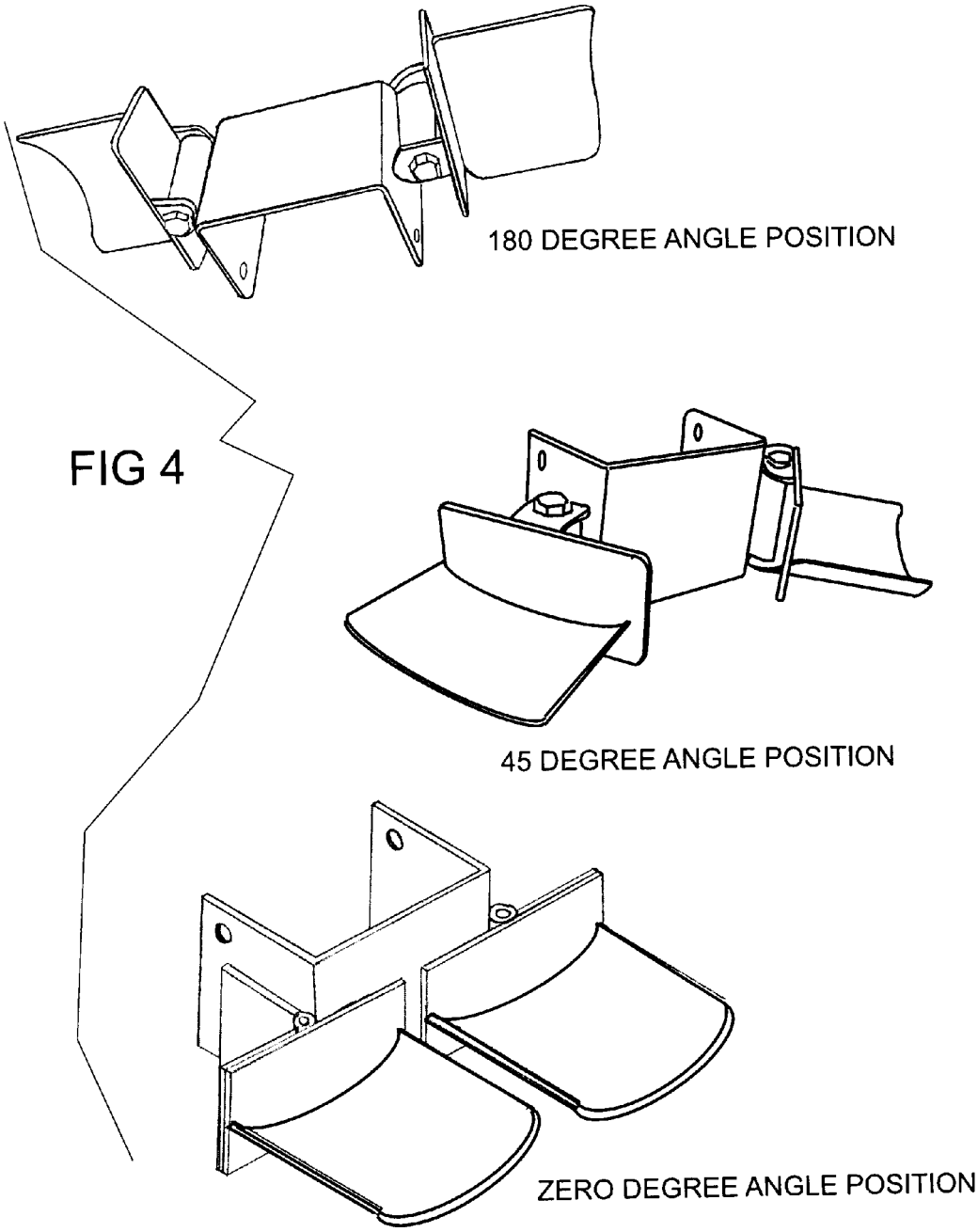
FIG. 4 is perspective view of the dual rotating jump cup invention.
Figure 5:
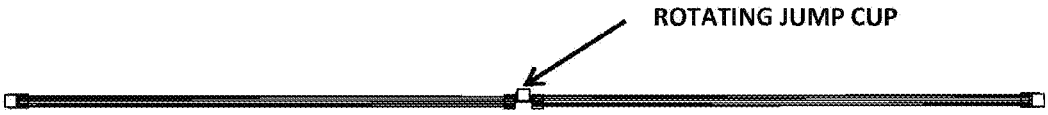
FIGS. 5, 6 and 7 are plan views showing different angles in which the dual jump cups can be independently positioned to hold two jump poles.
Figure 6:
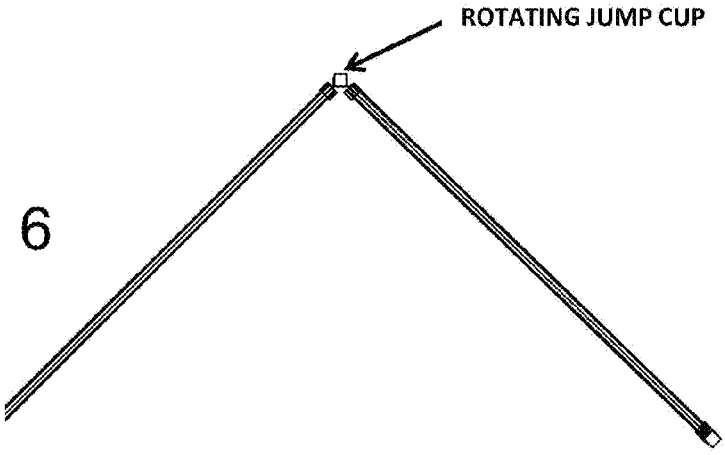
Figure 7:
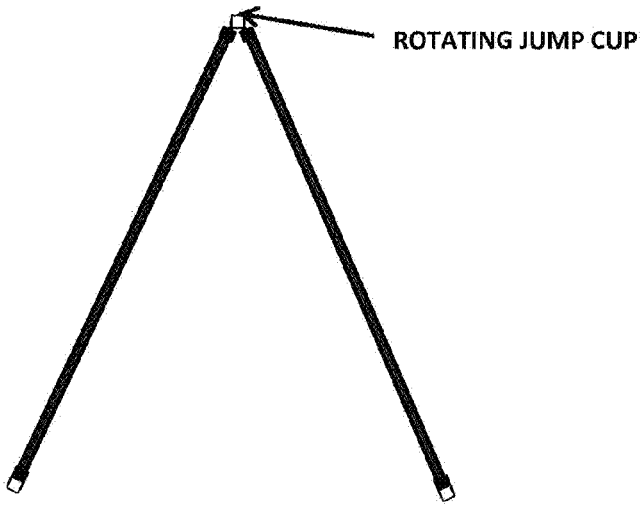
Figure 9B:
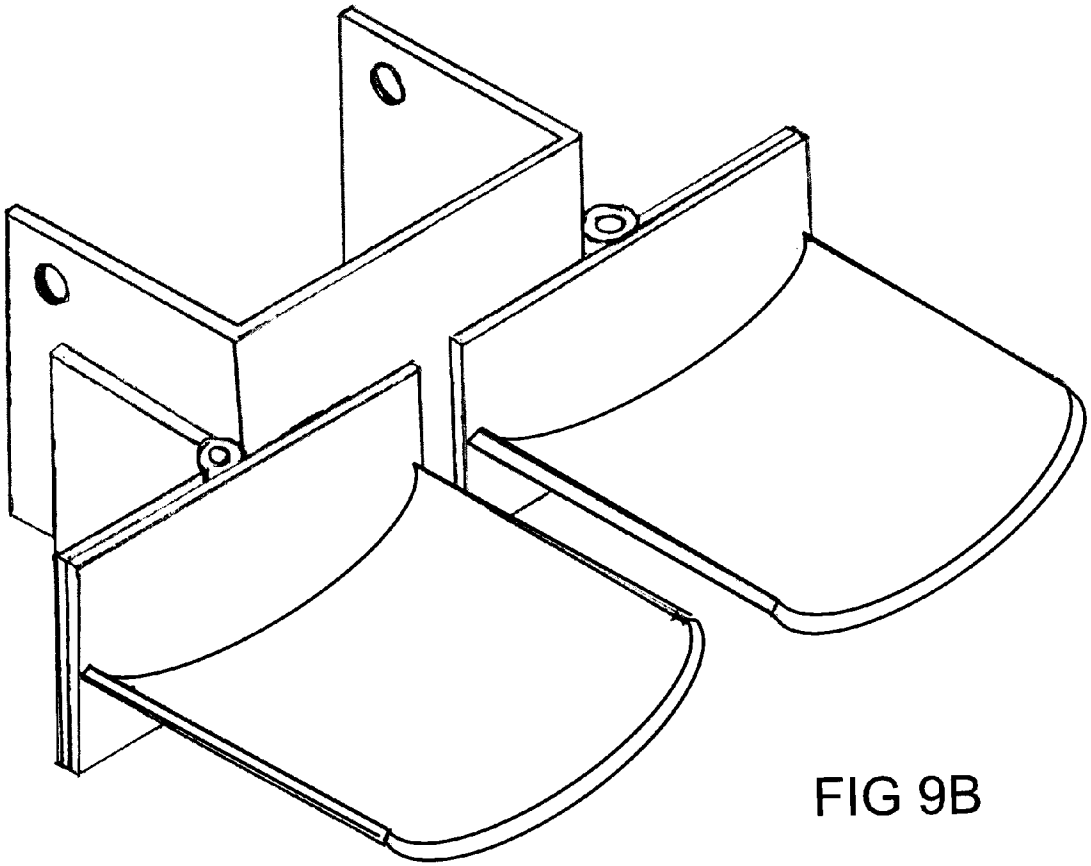
Figure 10:
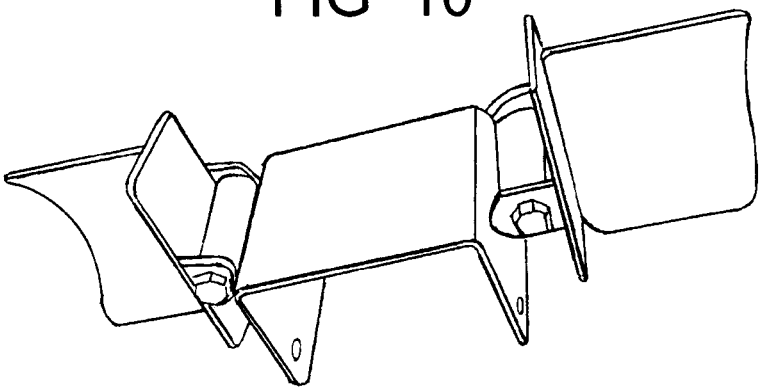
FIG. 10 shows the dual jump cups in a 180 degree position.
Figure 11:
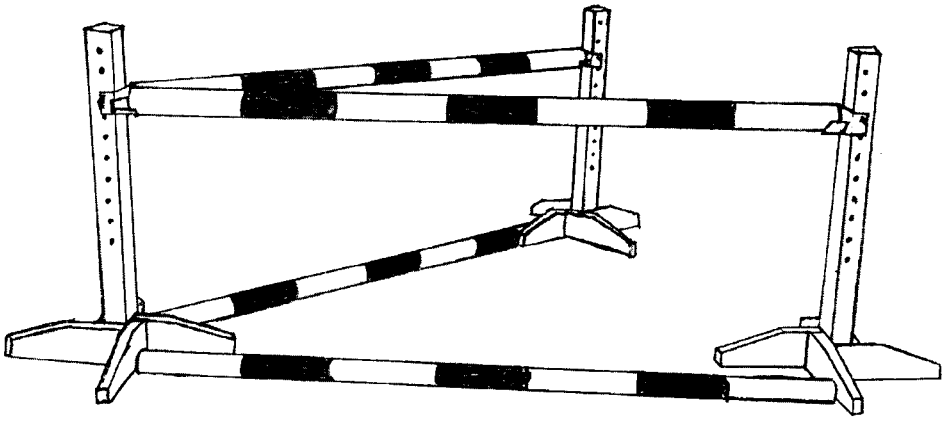
FIG. 11 shows and acute angle jump fence.
Figure 14:
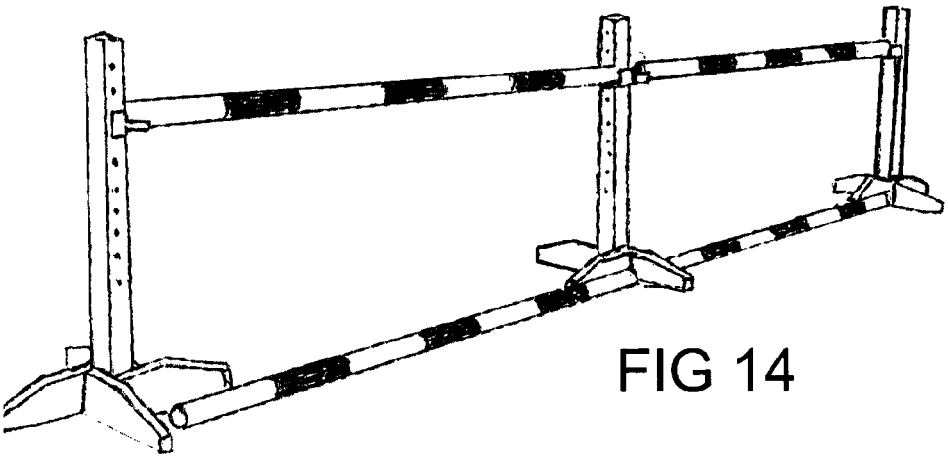
FIG. 14 shows a fence in a 180 degree angled jump configuration.
Figure 15:
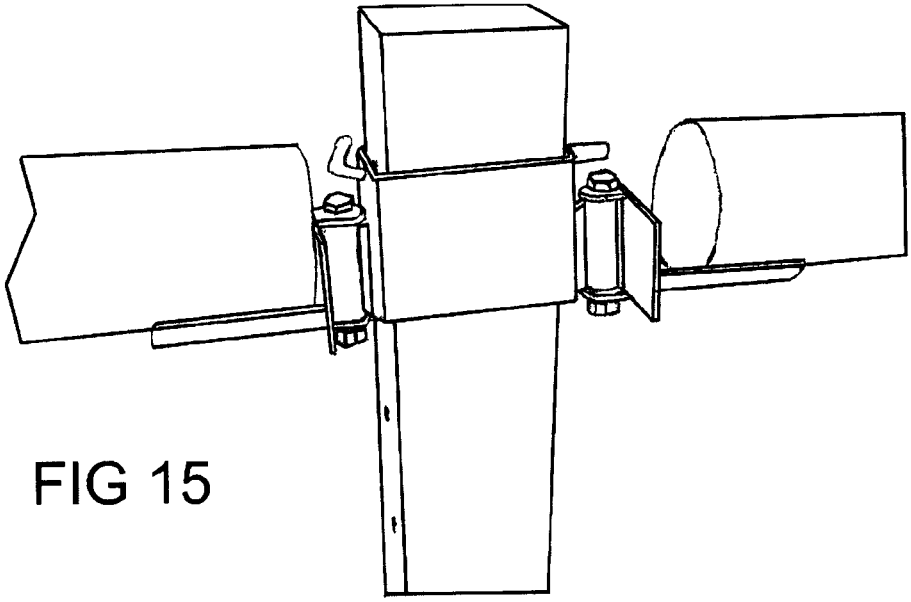
FIG. 15 shows two jump poles mounted in the dual cup in a 180 degree angled position.
Figure 16D:
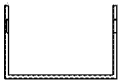
FIG. 16C is a rear view of the jump cup mounting member and FIG. 16D is a top view of the jump cup mounting member.
Figure 16C:
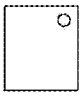
Figure 16A:
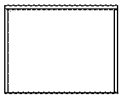
FIG. 16A is top view of a jump cup and FIG. 16B is a top view of a jump cup.
Figure 16B:
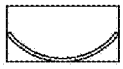
Figure 17A:
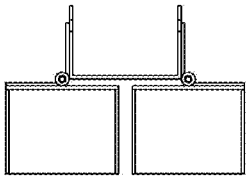
FIG. 17 A is a top view of dual jump cups in a zero angled position and FIG. 17B is a top view of the dual jump cups in an acute angled position.
Figure 17B:
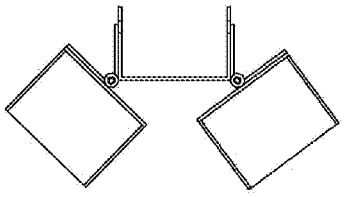

A dual rotating jump cup assembly 30 according to FIG. 3 can hold a two jump poles and be affixed to a single jump standard. The jump cup 30 can be rotated to any variable angle from zero to 90 degrees. This allows the jump poles to have a variable spread for the horse to jump over. The dual rotating jump cup assembly consists of two concave plates 31, two jump cup backing plates 32, two jump cup hinges 33, and one U shaped flange 34 with a pair of alignment holes 35 which are used in conjunction with a pin to affix the dual rotating jump cup assembly to a single standard. FIG. 4 shows three typical positions of an infinite number of angles that the jump cups can be positioned to hold jump poles. When the dual jump cups are positioned at 90 degree or greater to the 180 degree setting, the jump poles and standards can be used as individual jumping fences or to create a barrier fence when creating a jump chute for free jumping of horses.

Construction Materials

The dual rotating jump cup assembly construction materials are to be made of steel or plastic such as polypropylene.

Alternate Pin Attachment Design

An alternate design to the pinned attachment design is a peg style design. The peg style consists of two pegs that are mounted to the flat back plate in lieu of the U shaped flange. The pegs are locked into slotted holes on the metal receiver flange used on the peg style jump standard. Reference: Dual Rotating Jump Cup with peg attachment drawing.

DEFINITIONS

Horse Jumping Obstacles

Various obstacles are found in competitive sports involving Horse jumping. These include show jumping, hunter, and the cross-country phase of the equestrian discipline of eventing. The size and type of obstacles vary depending on the course and the level of the horse and rider, but all horses must successfully negotiate these obstacles in order to complete a competition. Fences used in hunter and eventing are generally made to look relatively rustic and natural.

In jumping competition, they are often brightly colored and creatively designed. In hunter and jumper competition, obstacles are constructed to fall down if struck by the horse. In eventing, they are built to be solid, though for safety, certain elements may be designed to break away if hit. (Ref. Wikipedia)

Jump Standard

Typically a 4"×4" wooden column with support base with thru holes vertically spaced at a distance of 3" on center. The holes provide way to attach a jump to the wooden standard.

Jump Cup

A formed metal assembly designed to have a curved cup to support a jump pole and an U shaped attachment plate so the assembly can be attached to a jump standard with a pin.

Jump Pole

A wooden pole approximately 12 feet long placed in the cradle of a jump cup on opposing two jump standards to form a horse jumping obstacle.

Free Jumping

Free jumping or loose jumping is the practice of jumping a horse without a rider. It is often conducted in a chute and is used most often to evaluate the jumping ability of horses too young to jump under saddle.[1] The correlations between free jumping and eventual success in show jumping competition have been the subject of several studies. Free jumping is used as a diagnostic tool by most warmblood breeding societies to evaluate jumping prowess in breeding stock. This practice is used to build a horse's confidence over jumps without a rider's interference, to evaluate a horses jumping ability, or to showcase a horse that is for sale. This training method is used in a variety of ways, both professionally and recreationally. Free jumping is also done competitively, primarily with younger horses that are not old enough for a rider or just beginning their jumping career. (Ref. Wikipedia)

Jump Chute

A jump chute consists of all the jumps in the line as well as a small stretch for entry and exit so the horse approaches and leaves the jumps straight. The width of the chute is the width of the poles for the jumps. The "walls" of the chutes usually consist of jumping poles at a height above the highest jump with additional poles underneath if there is a chance the horse will try to go under the poles. (Ref. Wikipedia)

Corner Obstacle

Also called an apex, corner fences are in a triangular shape with the horse jumping over one corner of the triangle. They are similar to the "fan" jump seen in show-jumping. As the name suggests, the fence makes a "V" shape, which can have an angle up to 90 degrees. At novice levels, the fence is formed by two angled fences, open in the center while more advanced designs have a solid triangular cover. The corner is meant to be jumped on a line perpendicular to an imaginary bisecting line of the angle,[1] and as close to the narrow apex as possible while still far enough in on the jump that the horse knows he is supposed to go over it. If the rider aims too far toward the wider section of the obstacle, it may be too wide for the horse to clear it. This usually results in a stop or run out, although some of the braver horses might "bank" a solid corner fence (touching down on it before quickly jumping off). This is not desirable, as the horse is more likely to slip, catch a leg, or fall. If the rider aims too far toward the apex, it is very easy for the horse to run right past, especially if is unsure as to whether he is to jump the obstacle. Due to their relative difficulty, the corner is not seen at the lowest levels. The corner is a precision fence, requiring accurate riding and good training, with the horse straight and between the rider's aids. Due to the build of the fence, an uncommitted horse and rider pair may have a run-out at this type of obstacle. It is best that the rider use their aids to "block" the horse from running out to the side, with a strong contact to prevent the shoulders from popping, and a supporting leg. (Ref. Wikipedia)

Vertical Jump

Vertical (or upright)—a jump that consists of poles or planks placed one directly above another with no spread, or width, to jump. (Ref. Wikipedia)

REFERENCE INFORMATION

Reference: Dual Rotating Jump Cup with pin attachment drawing.

Reference: Dual Rotating Jump Cup with peg attachment drawing.

U.S. Pat. No. 5,690,583 JUMP CUP ADAPTED TO BE MANIPULATED BY ONE HAND

U.S. Pat. No. 5,967,093 EQUESTRIAN JUMP AND BRACKET FOR CREATING AN ANGULAR OBSTACLE

Horse jumping obstacles: [00] See Wikipedia Section 8—Corners ttp://en.wikipedia.org/wiki/Horse_jumpin-g_obstacles Free Jumping Definition See Wikipedia—http://en.wikipedia.org/wiki/Free_jumping

The invention claimed is:

1. An equestrian jump cup attachable to an equestrian jump standard to support an equestrian jump pole, the equestrian jump cup comprising:

a curved plate dimensioned to support an end of the equestrian jump pole;

a mounting member attachable to the equestrian jump standard; and a hinge between the curved plate and the mounting member so that the curved plate is rotatable relative to the mounting member so that the equestrian jump pole can be positioned to extend in different horizontal angles relative to the jump standard, without reattachment of the mounting member.

2. The equestrian jump cup of claim 1 wherein two curved plates are positioned on opposite sides of the mounting member, each curved plate being attachable to the mounting member by the hinge so that the two curved plates can be independently rotatable relative to the mounting member so that two jump poles can be positioned at different angles relative to one jump standard.

3. The equestrian jump cup of claim 1 wherein the mounting member includes at least one opening for receipt of a pin, so that the jump cup can be pinned to the jump standard.

4. The equestrian jump cup of claim 3 wherein the mounting member comprises a U-shaped flange.

5. The equestrian jump cup of claim 1 wherein each curved plate comprises a concave member with an upwardly facing concave surface in which a jump standard is supportable.

6. The equestrian jump cup of claim 1 wherein the jump cup is rotatable through an angle of at least ninety degrees relative to the mounting member.

7. The equestrian jump cup of claim 1 wherein the hinge extends vertically parallel to the jump standard on which the jump cup is mountable.

8. The equestrian jump cup of claim 1 wherein the curved plate comprises a plastic member.

9. An equestrian jump corner obstacle comprising:

two equestrian jump poles extending at acute horizontal angles relative to each other;

a single corner jump standard with the two jump poles extending at acute angles away from the single corner jump standard;

two end jump standards forming end supports for the two jump poles, the two end jump standards being positioned in opposite angled directions relative to the single corner jump standard;

a jump cup mounted on the single corner jump standard, the jump cup comprising a mounting member with two separate curved plates hinged relative to the mounting member and supporting ends of the jump poles adjacent the single corner jump standard, the two separate curve plates being mutually rotatable and rotatable to the mounting member about an axis parallel to the corner jump standard.

10. The equestrian jump corner obstacle of claim 9 wherein the mounting member is pinned relative to the single corner jump standard.

11. The equestrian jump corner obstacle of claim 9 wherein hinged jump cups are mounted on the two end jump standards to support ends of the two jump poles.

12. The equestrian jump corner obstacle of claim 9 wherein the curved plates comprise concave plates with concave surfaces facing upwardly to support an end of a jump pole.

13. The equestrian jump cup corner obstacle of claim 9 wherein hinges mounting the curved plates to the mounting members extend vertically parallel to the jump standard on which the jump cup is mountable.

14. An equestrian jump obstacle comprising:

two equestrian jump poles;

two end jump standards forming end supports for the two jump poles;

a single inner jump standard with the two jump poles extending in opposite directions away from the from the single interior jump standard;

a jump cup mounted on the single inner jump standard, the jump cup comprising a mounting member with two curved plates hinged relative to the mounting member and supporting ends of the jump poles adjacent the single corner jump standard so that the jump poles can extend in horizontal directions away from the single inner jump standard at any angle up to one hundred eighty degrees, depending upon the relative positions of the two end jump standards.

* * * * *